United States Patent [19]

Buelteman

[11] Patent Number: 4,740,307

[45] Date of Patent: Apr. 26, 1988

[54] SWIMMING POOL WATER SKIMMING AND VACUUMING APPARATUS

[76] Inventor: Vernon P. Buelteman, 630 Crest Dr., Vista, Calif. 92083

[21] Appl. No.: 107,804

[22] Filed: Oct. 13, 1987

[51] Int. Cl.[4] ..... E04H 3/20

[52] U.S. Cl. ..... 210/169; 210/232; 210/416.2; 134/167 R; 4/512

[58] Field of Search ..... 210/169, 416.2, 232; 134/167 R; 4/490, 512

[56] References Cited

U.S. PATENT DOCUMENTS

| | | | |
|---|---|---|---|
| 3,443,264 | 5/1969 | Miller | 210/169 |
| 3,481,470 | 12/1969 | Valois | 210/169 |
| 3,508,661 | 4/1970 | Diemond et al. | 210/169 |
| 3,864,262 | 2/1975 | Lang et al. | 210/169 |
| 4,126,925 | 11/1978 | Jacuzzi | 210/169 |
| 4,154,679 | 5/1979 | Farage | 210/169 |
| 4,348,281 | 9/1982 | Perry et al. | 210/169 |
| 4,426,286 | 1/1984 | Puckeh et al. | 210/169 |
| 4,454,035 | 6/1984 | Stefan | 210/169 |

*Primary Examiner*—Peter Hruskoci
*Assistant Examiner*—Coreen Y. Lee
*Attorney, Agent, or Firm*—Duane C. Bowen

[57] ABSTRACT

An automatic pool vacuum unit is connected to a skimmer housing by a vacuum housing fitted in an inverted U-shaped opening in the skimmer weir, open to the bottom of the weir. In order to avoid interfering with normal pivoting of the buoyant weir by the vacuum housing, the housing in planes at right angles to the pivotal axis of the weir has upper outlines that are arcuate about that axis, and the vacuum housing has an outline matching the outline of the inverted U-shaped opening in planes through the weir pivotal axis, so that the vacuum housing substantially fits and substantially seals the weir opening as the weir pivots. A removable cover over the debris-collecting basket in the skimmer housing has an opening connecting with the vacuum housing and an adjustable opening for skimmer water spilling over the top of the weir. The vacuum housing is removably secured to the cover to facilitate removal of the debris collecting basket.

10 Claims, 3 Drawing Sheets

SWIMMING POOL WATER SKIMMING AND VACUUMING APPARATUS

BRIEF SUMMARY OF THE INVENTION

BACKGROUND AND OBJECTIVES

My invention relates to apparatus to skim and vacuum water in a swimming pool.

Apparatus for skimming water in swimming pools is well developed. Rather standard models have been developed including a skimmer housing, a buoyant weir pivotally mounted in a broad side water inlet to the housing, a recirculation pump connection to the bottom of the housing, a debris collecting basket above the outlet to the pump, and a top opening and a top lid in the housing for operations like the cleanout of the basket. It is desirable to connect a swimming pool vacuuming hose to the skimmer assembly as a source of vacuum. This has been awkward to accomplish thus far. Usually it has been done by removal of the top lid, by removal of the basket, and by insertion of the vacuum line through the top of the skimmer housing and by connection to the outlet to the pump in the bottom of the skimmer housing. This is time consuming, awkward and unattractive and prevents skimming action until the apparatus is restored to its original condition. The vacuum hose instead can be inserted through the water inlet to the housing, over the weir, but the same disadvantages are present.

It is an objective of my invention to use a skimmer housing assembly as means to which a vacuum hose can be connected and which provides a source of vacuum for the hose: (a) by a simple connection always available and not requiring disassembly of parts of the skimmer apparatus, (b) by a connection not disabling the weir and permitting simultaneous vacuuming and skimming, (c) by a connection permitting quick change between all-skimming and all-vacuuming operations, and (d) by a connection maintaining an attractive appearance of the apparatus.

Further objectives include providing an economical, durable construction and providing means adaptable to add a vacuuming function to existing skimmer assemblies already in use.

My invention will be best understood, together with additional advantages and objectives thereof, when read with reference to the drawings.

DRAWINGS

SPECIFIC DESCRIPTION

Figure 1:
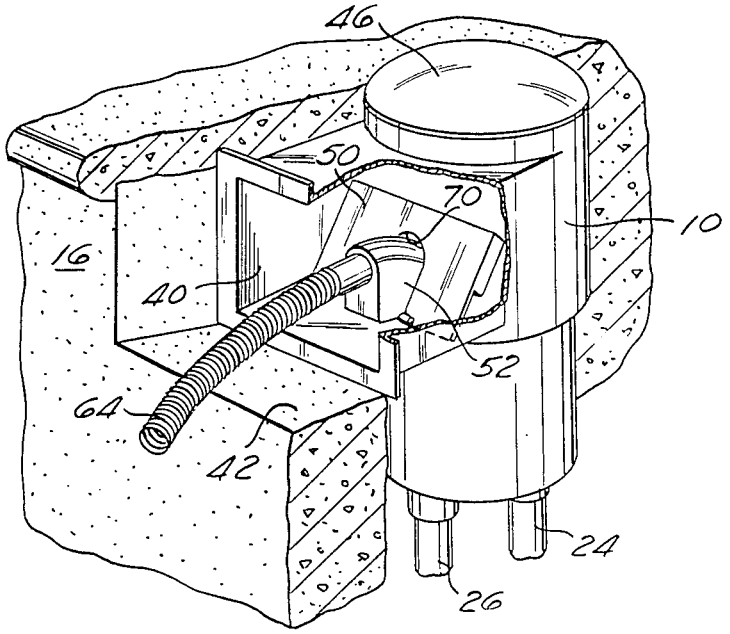
FIG. 1 is a perspective view of apparatus to skim and vacuum water in a swimming pool. The assembly is shown embedded in the concrete of the swimming pool.
Figure 2:
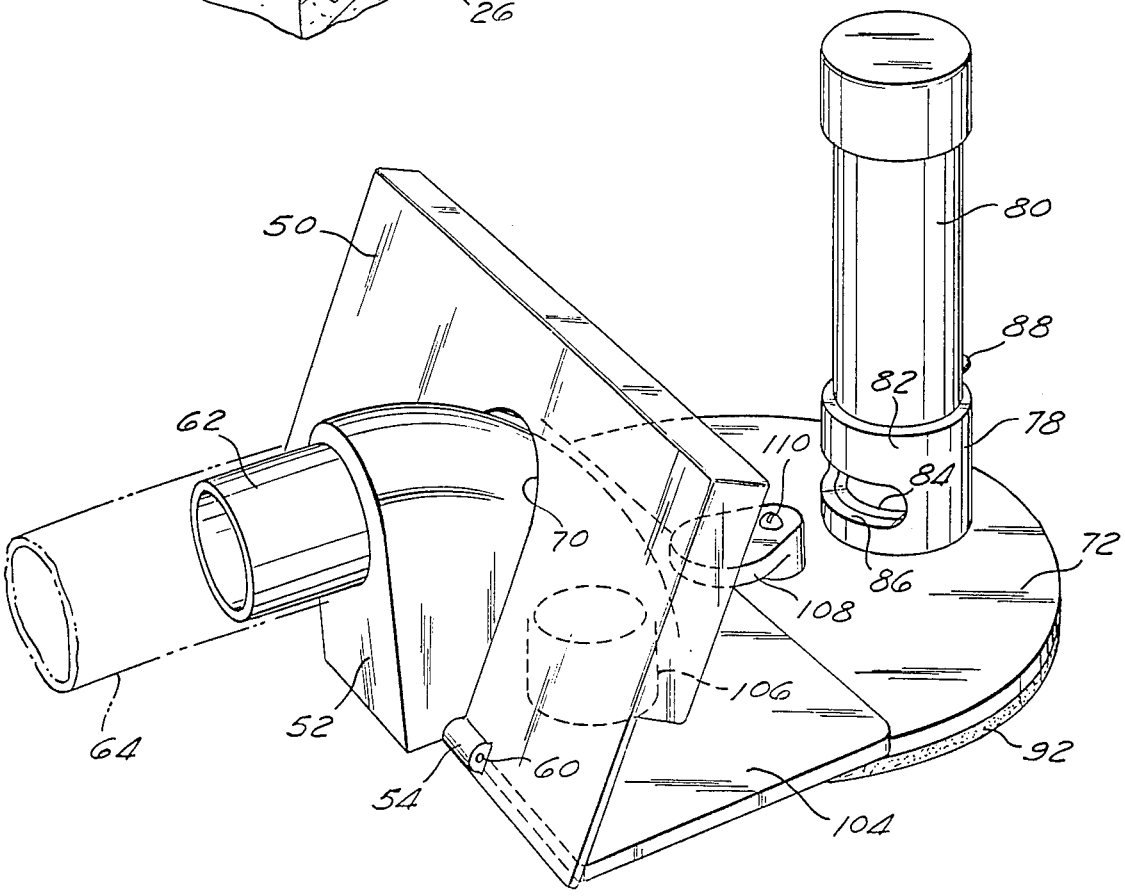
FIG. 2 is an enlarged perspective view of portions of the assembly. A portion of a vacuum line is shown on the left in dashed lines.
Figure 3:
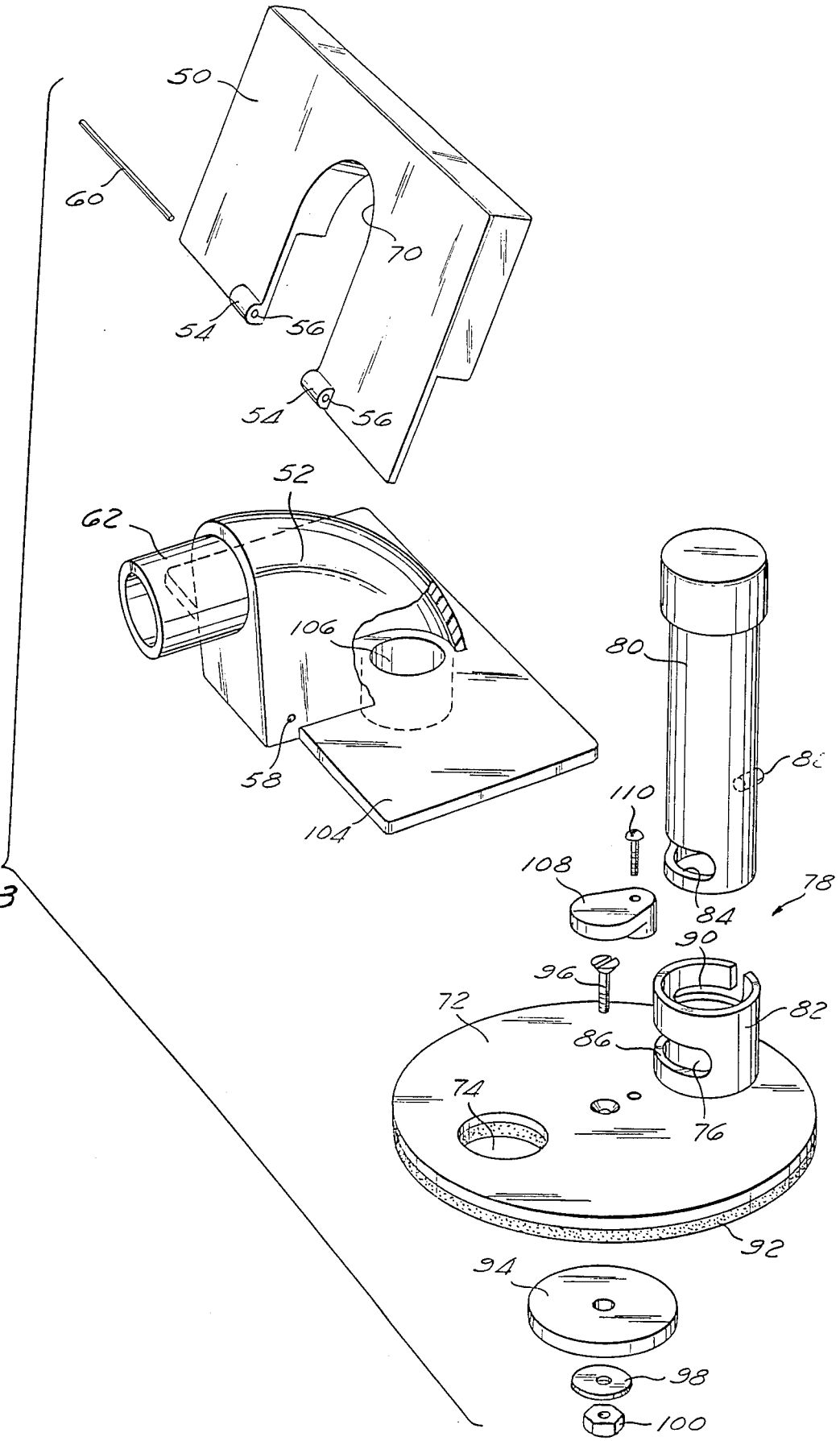
FIG. 3 is an exploded perspective view of the assembly portions shown in FIG. 2.

I first will describe the portion of the skimmer that was produced before my invention. This prior art structure is typical of skimmers previously sold and installed in swimming pools.

The skimmer has a plastic housing 10. The lower portion has a recess 12 in which is fitted a basket 14 pervious to water. Large particles such as leaves, twigs and grass will be retained in basket 14. Floating particles in swimming pool 16 will be "skimmed" from the surface water 18 spilling into housing 10 and will be caught in basket 14.

A pair of threaded openings 20, 22 in the bottom of housing 10 are designed to receive threaded tubes 24, 26 which connect to pump 28 and pool drain 30 respectively. Pump 28 recirculates water in the swimming pool 16 and filters water by means of a suitable filter 32. Water can be recirculated from pool drain 30 through line 26, through the bottom of skimmer housing 10, through line 24, past pump 28 and filter 32, to pool 10. When an automatic pool vacuum unit 34 is used, recirculation from pool drain is not needed, and most pool owners will deactivate line 26 to drain 30 by installing a plug 36 threaded into opening 22. There are a number of automatic pool vacuum units on the market such as Pool Vac, manufactured by Aquanaut, Inc.; Aquabots, Aqua Products, Inc.; Polaris Vac-Sweep, Alopex Industries, Inc.; and Oscar, Vegas Outdoor Products, for examples.

Skimmer housing 10 is connected to the vacuum side of pump 28 so that water in housing 10 is exhausted by pump 28 whenever pump 28 is powered. Surface water 18 normally enters skimmer housing 10 through a broad inlet 40 in a side of housing 10. As shown in FIG. 1, skimmer housing 10 is usually set in the concrete that forms pool 16 and inlet 40 may be set in a recess 42 to conceal the same and to discourage children from playing with the skimming apparatus. Housing 10 has a circular, top servicing opening 44 for purposes such as removing and emptying basket 14. A lid 46 normally covers opening 44.

A hollow buoyant weir 50 is pivotally mounted in inlet 40. Weir 50 makes a reasonably close fit to the sides of inlet 40 and is pretty much water tight as to its bottom pivotal support so that water entering housing 10 must spill over the top of weir 50. This will be surface water 18 in which debris like leaves are floating, hence the water in pool 16 will be "skimmed". Weir 50 being buoyant and pivoted from its bottom edge, the normal position of repose of weir 50 is in a vertical plane. As water is pumped out of housing 10, however, weir 50 tips until water spills over its top to replenish the water supply in housing 10.

All of the foregoing is old in the prior art. I will now describe my improvement. My invention applies both to skimmers previously sold and installed and to new skimmers. In the case of old skimmers, the old weir needs to be removed whereas in new manufacture the weir assembly will be manufactured according to my specifications in the first place. Removal of an existing weir in old installations should not be too difficult. Typically, the weir is pivotally mounted by a piano-type hinge and the lower leaf of the piano hinge is secured to the bottom wall of housing inlet 40 with a pair of fasteners, which would need to be removed.

My weir 50 is mounted on a hollow plastic vacuum housing 52. A pair of lugs 54 are shown on weir 50 with through openings 56 matching an opening 58 through vacuum housing 52, and a pin 60 is disposed in openings 56, 58 to form a pivotal support for weir 50.

The basic function of vacuum housing 52 is to get the vacuum line to automatic vacuum unit 34 past weir 50 without interfering with the normal pivoting of weir 50 to perform its normal skimming function of inward pivoting when pump 28 exhausts water from skimmer housing 10. The outer end of vacuum housing 52 is formed as a nipple 62 which is connected to automatic vacuum unit 34 by a flexible, corrugated, plastic tube 64.

Figure 4:
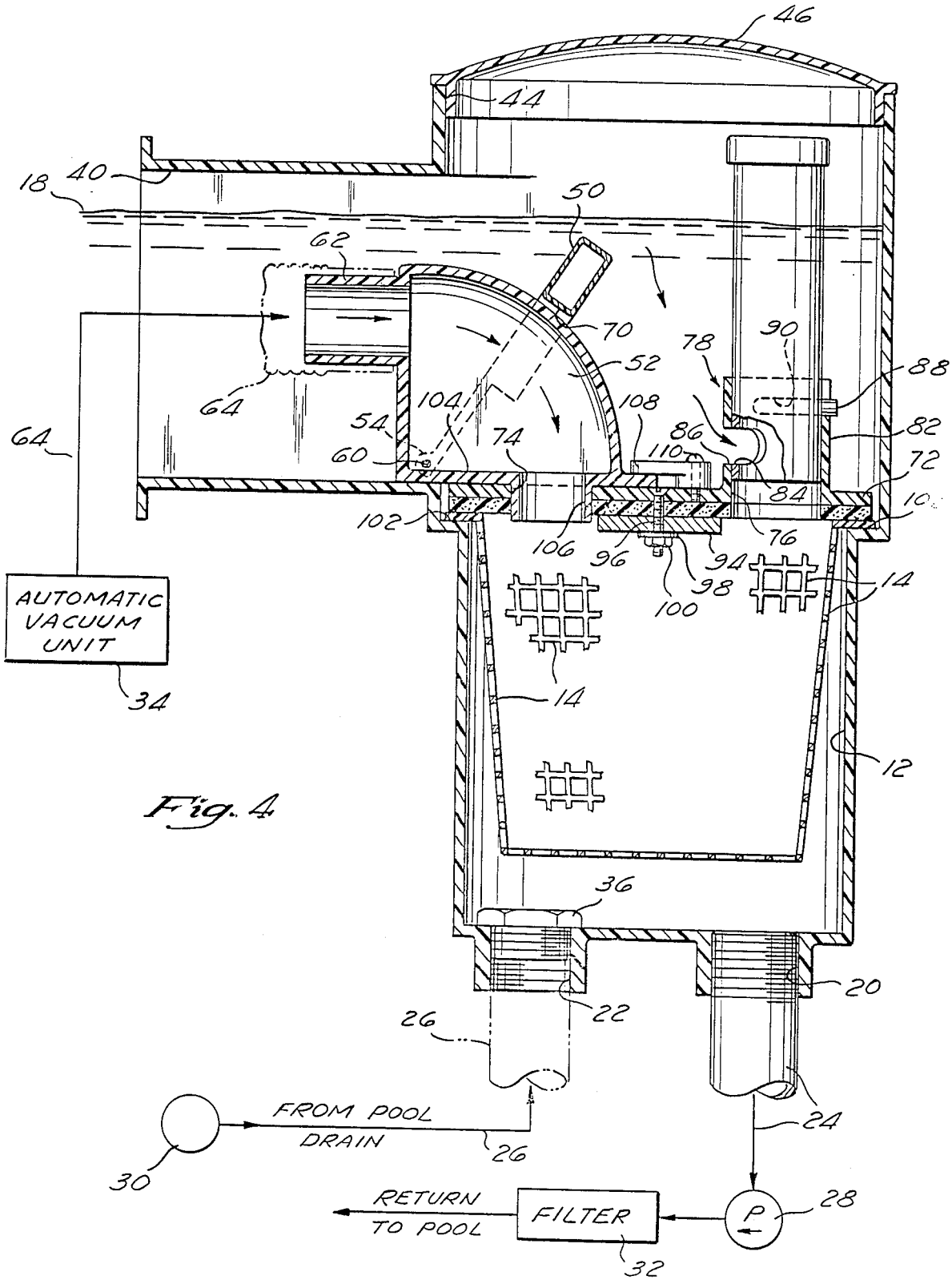
FIG. 4 is a side view, partly in section. Swimming pool water is indicated including skimming water spilling over top of the skimmer weir.

Weir 50 has an opening 70 to its lower edge. Opening 70 has generally the form of an inverted U-shape. In order for weir 50 to pivot without interference by vacuum housing 52 and yet for there to be a minimum gap between the edges of opening 70 and the adjacent surfaces of vacuum housing 52, (a) as to the cross-sections of vacuum housing 52 in planes intersecting the axis of pivoting of weir 50 (the axis of pin 60), those cross-sections have to be substantially identical with the inverted U-shaped outline of opening 70 in weir 50 within the arc of pivoting of weir 50 and (b) the cross-section of the upper, outer surfaces of vacuum housing in planes at right angles to the axis of pin 60 must be arcuate about that axis within the limits of pivoting of weir 50 (see FIG. 4), so that vacuum housing 52 substantially fits and substantially seals opening 70 as weir 50 pivots.

A cover 72 is provided within skimmer housing 10 over the area of recess 12 containing basket 14. Cover 72 serves several functions: (a) it is part of the mounting of vacuum housing 52, (b) it has a vacuum opening 74 so that pump vacuum can be applied from recess 12 through vacuum opening 74, through vacuum housing 52, through line 64 to automatic pool vacuum unit 34 for pool vacuuming, and (c) it has a skimming opening 76 for skimming water spilling over the top of weir 50 which has a valve 78 operative to close skimming opening 76 when it is desired to switch pump vacuum totally from skimming to vacuuming.

In effect, vacuuming opening 76 is closed when automatic pool vacuum unit is deactivated, i.e., is turned off, is lifted out of pool 16, or flow is otherwise entirely of substantially eliminated, so that only skimming is performed by the action of pump 28. When it is desired to have both vacuuming and skimming, valve 78 can be left partly or totally open, whereas when the full effect of pump 28 on automatic pool vacuum unit 34 is desired, valve 78 will be closed. If automatic pool vacuum unit 34 is disconnected from opening 76, a cap may be used to close opening 76.

Valve 78 has an upstanding tube part 80 extending to a level above the normal level of water in skimmer housing 10. This means the valve can be adjusted by rotation of tube 80 (by means of access by removal of lid 46) without getting the operator's hands wet. Tube part 80 interfits with an upstanding annulus 82 around skimming opening 76. Openings 84, 86 in tube part 80 and annulus 82, respectively, have maximum registry in one rotary position of tube 80 for the maximum flow of skimming water down into recess 12, and are completely out of registry in another rotary position of tube 80 in order to block any flow through skimming opening 76. A stud 88 on tube 80 in a slot 90 in annulus 82 limit rotation of tube 80.

To seal cover 72 above recess 12, a resilient pad 92 is secured to cover 72 by an annulus 94, a bolt 96, a washer 98 and a nut 100. Pad 92 bears on a basket flange resting on an annular ledge 102 in housing 10. Basket 14 is suspended from ledge 102.

Cover 72 needs to be removable through top opening 44 in order to remove basket for emptying of collected debris. This may be best accomplished as shown by dividing vacuum housing 52 from cover 72. The rectangular base 104 of housing 52 sits on cover 72 and on the bottom of inlet 40 and fits against the sidewalls of inlet 40. It is secured in place by an annular flange fitting in vacuum opening 74 and by an arm 108 secured to cover 72 by a bolt 110. Arm 108 can be turned between a position securing base 104 and a position releasing base 104.

When the word "vacuum" is used in connection with automatic pool vacuum unit 34, in connection with pump 28, etc., it is used in the usual sense of the word in the art. The inlet side of the pump may be said to be of low pressure or "vacuum" relative to the head of water in the pool, so water will move toward the inlet side of the pump to try to equalize pressure during pump operation.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. Apparatus to skim and vacuum water in a swimming pool, comprising:

(a) a skimmer housing and a broad inlet in a side thereof partly submerged in said water in said swimming pool whereby surface water will tend to enter into said skimmer housing through said inlet, (b) a buoyant weir extending from side to side of said inlet, said weir having its lower portion pivotally mounted in said skimmer housing and said weir normally assuming an upright position blocking flow of water through said inlet because of its normal upright floating position of repose in said water, (c) a recirculation pump connected to the lower portion of said skimmer housing whereby upon activation of said pump skimming action occurs in said pool due to withdrawal of water from said skimmer housing and consequent inward tipping of said weir and spilling of surface water with floating debris over the top of said weir into said skimmer housing, (d) the lower portion of said weir having an opening to the lower edge thereof and a hollow vacuum housing positioned in said opening, said vacuum housing in planes at right angles to the pivotal axis of said weir having upper outlines that are arcuate about said axis within the limits of pivoting of said weir and said vacuum housing having an outline matching the outline of said opening in planes through said axis within the limits of pivoting of said weir so said vacuum housing substantially seals said opening in said weir as said weir pivots, (e) a vacuum line detachably connected to the pool end of said vacuum housing to perform vacuum operations on said water in said pool, (f) said skimmer housing having a recess in its lower portion and a basket pervious to water positioned in said recess to collect debris skimmed from said water in said pool, and (g) a cover removably positioned within and fitting said skimmer housing above said basket and said cover having a skimming opening for skimming water and a valve operative to close said skimming opening when it is desired to switch pump vacuum from skimming to vacuuming and a vacuum opening in said cover and said vacuum housing connecting to said vacuum opening so that pump vacuum can be applied from said recess through said vacuum opening in said cover through said vacuum housing to said vacuum line for pool vacuuming.

2. The apparatus matter of claim 1 in which said opening in the lower portion of said weir to the lower edge thereof has a generally inverted U-shaped outline.

3. The apparatus of claim 1 in which said valve includes a fixed annulus around said skimming opening and a tube interfitting with said annulus and rising to a level above the level of water in said skimmer housing so that said tube can be manipulated without wetting of the operator's hand, said annulus and said tube having mating openings that register to admit skimming water to said skimming opening in a registered position and said openings moving to a position out of registry as said tube is manually rotated thereby to terminate skimming operation.

4. The apparatus of claim 1 in which said cover is circular and said skimmer housing has a top opening of a size to pass said cover whereby said cover can be inserted and removed and said basket can be serviced.

5. The apparatus of claim 1 in which said vacuum housing has a movable base supporting the same including a flange lapping onto said cover which is separate from said vacuum housing to facilitate removal of said cover through said top opening of said skimmer housing and said cover having latch means acting on said flange to help hold said vacuum housing in place.

6. The apparatus of claim 5 in which said base of said vacuum housing has an opening with a depending annular flange therearound which fits into said vacuum opening in said cover.

7. The apparatus of claim 5 in which said weir is pivotally mounted on said base of said vacuum housing.

8. Apparatus to skim and vacuum water in a swimming pool, comprising:

(a) a skimmer housing and a broad inlet in a side thereof partly submerged in said water in said swimming pool whereby surface water will tend to enter into said skimmer housing through said inlet, (b) a buoyant pivotal weir body extending from side to side of said inlet, said pivotal weir body having its lower portion pivotally mounted in said skimmer housing and said pivotal weir body normally assuming an upright position blocking flow of water through said inlet because of its normal upright floating position of repose in said water, (c) a pump opening in the lower portion of said skimmer housing and a recirculation pump connected to said pump opening whereby upon activation of said pump skimming action occurs in said pool due to withdrawal of water from said skimmer housing and consequent inward tipping of said pivotal weir body and spilling of surface water with floating debris over the top of said pivotal weir body into said skimmer housing, (d) said pivotal weir body having an opening therethrough and a hollow vacuum housing positioned in said opening and said vacuum housing being arcuately shaped relative to the pivotal axis of said pivotal weir body so that said vacuum housing will not interfere with pivoting of said weir body, (e) a vacuum line detachably connected to the pool end of said vacuum housing to perform vacuum operations on said water in said pool, (f) the inner end of said vacuum housing being disposed in said skimmer housing to be subject to pump vacuum in order to perform pool vacuum operations, and (g) said skimmer housing having a recess in its lower portion and a basket pervious to water positioned in said recess to collect debris skimmed from water in said pool.

9. The apparatus of claim 8 in which there is manually operable valve means in said skimmer housing downstream of said weir operative to block flow of water spilling over said weir from reaching said pump when it is desired to perform vacuum operations without skimmer operations.

10. The apparatus of claim 8 in which there is a cover removably positioned within and fitting said skimmer housing above said basket and said cover having a skimming opening for skimming water and a valve operative to close said skimming opening when it is desired to switch pump vacuum from skimming to vacuuming and a vacuum opening in said cover and said vacuum housing connecting to said vacuum opening so that pump vacuum can be applied from said recess through said vacuum opening in said cover through said vacuum housing to said vacuum line for pool vacuuming.

* * * * *